US011519683B2

(12) United States Patent
Lamboy

(10) Patent No.: US 11,519,683 B2
(45) Date of Patent: Dec. 6, 2022

(54) AIR GUN MAGAZINE SAFETY SYSTEM

(71) Applicant: UMAREX USA, INC., Fort Smith, AR (US)

(72) Inventor: Stephen R. Lamboy, Fort Smith, AR (US)

(73) Assignee: UMAREX USA, INC., Fort Smith, AR (US)

( * ) Notice: Subject to any disclaimer, the term of this patent is extended or adjusted under 35 U.S.C. 154(b) by 0 days.

(21) Appl. No.: 17/109,461

(22) Filed: Dec. 2, 2020

(65) Prior Publication Data

US 2021/0080210 A1 Mar. 18, 2021

Related U.S. Application Data

(63) Continuation of application No. 16/436,604, filed on Jun. 10, 2019, now Pat. No. 10,883,784.

(51) Int. Cl.

| | |
|---|---|
| ***F41A 17/36*** | (2006.01) |
| ***F41B 11/00*** | (2013.01) |
| ***F41B 11/50*** | (2013.01) |
| ***F41A 17/46*** | (2006.01) |
| ***F41B 11/723*** | (2013.01) |

(52) U.S. Cl.

CPC ..... *F41A 17/36* (2013.01); *F41A 17/46* (2013.01); *F41B 11/50* (2013.01); *F41B 11/723* (2013.01)

(58) Field of Classification Search

CPC F41B 11/50; F41B 11/53; F41B 11/55; F41B 11/57; F41B 11/62; F41B 11/64; F41B 11/71; F41B 11/89; F41B 11/723; F41A 17/00; F41A 17/30; F41A 17/32; F41A 17/34; F41A 17/36; F41A 17/38; F41A 17/46; F41A 17/48; F41A 17/56; F41A 17/64; F41A 17/74

USPC ..... 124/31, 40, 45, 65, 66, 67; 42/70.01, 42/70.02, 70.04, 70.05, 70.06, 70.08

See application file for complete search history.

(56) References Cited

U.S. PATENT DOCUMENTS

| | | | | |
|---|---|---|---|---|
| 2,563,720 A * | 8/1951 | Bonifacio | F41A 17/36 | 42/17 |
| 2,713,859 A * | 7/1955 | Bradfield | F41A 9/25 | 42/15 |
| 3,818,887 A * | 6/1974 | Akiyama | F41B 11/646 | 124/67 |
| 4,850,328 A * | 7/1989 | Sindel | F41B 11/55 | 124/66 |
| 4,986,251 A * | 1/1991 | Lilley | F41B 11/55 | 124/52 |
| 5,711,286 A * | 1/1998 | Petrosyan | F41B 11/55 | 124/76 |

(Continued)

*Primary Examiner* — Alexander R Niconovich

(74) *Attorney, Agent, or Firm* — Eric B. Fugett; Mark A. Pitchford; Pitchford Fugett, PLLC

(57) ABSTRACT

An air gun is provided with a magazine safety system and methods of making the air gun safe utilizing the magazine. The air gun includes a magazine well protrusion (e.g., floorplate) configured to extend into the magazine well when no magazine is properly inserted into and received in the magazine well. In the extended position, the protrusion prevents actuation of the main valve of the air gun. When a magazine is properly inserted into the magazine well, the protrusion is pushed into a recessed or depressed position by the interaction of the magazine with the magazine well such that the protrusion does not prevent actuation of the main valve of the air gun.

9 Claims, 6 Drawing Sheets

(56) References Cited

U.S. PATENT DOCUMENTS 5,727,538 A * 3/1998 Ellis ..... F41B 11/52 124/32
6,494,194 B2 * 12/2002 Shipachev ..... F41B 11/62 124/31
7,237,543 B2 * 7/2007 Su ..... F41B 11/724 124/71
7,398,776 B2 * 7/2008 Casas Salva ..... F41B 11/62 124/74
7,540,280 B2 * 6/2009 Liao ..... F41B 11/62 124/73
7,665,455 B2 * 2/2010 Salva ..... F41B 11/62 124/74
7,950,382 B2 * 5/2011 Maeda ..... F41B 11/55 124/76
8,156,930 B2 * 4/2012 Hu ..... F41A 17/36 124/52
8,261,650 B2 * 9/2012 Hagspiel ..... F41A 17/36 89/154
8,434,254 B1 * 5/2013 Watchorn ..... F41A 9/71 42/50
8,438,768 B2 * 5/2013 Kallio ..... F41A 17/46 42/70.02
8,714,145 B2 * 5/2014 Maeda ..... F41B 11/62 124/76
8,899,985 B2 * 12/2014 Walls ..... F41B 11/56 434/24
9,287,925 B2 * 3/2016 Wilczewski ..... H04W 74/085
9,719,747 B2 * 8/2017 Tiberius ..... F41A 33/04
9,772,156 B1 * 9/2017 Viviano ..... F41A 11/00
9,835,403 B2 * 12/2017 Kang ..... F41B 7/006
9,885,537 B2 * 2/2018 Tippmann, Jr. ..... F41B 11/723
9,952,015 B2 * 4/2018 Kang ..... F41B 11/55
10,295,303 B2 * 5/2019 Buys ..... F41B 11/62
10,330,430 B2 * 6/2019 Kang ..... F41B 11/71
11,313,642 B2 * 4/2022 DiBlasio ..... F41B 11/723
11,378,351 B2 * 7/2022 Liao ..... F41B 11/89
2005/0229459 A1 * 10/2005 McGarry ..... F41A 17/36 42/7
2007/0000483 A1 * 1/2007 Tsurumoto ..... F41A 17/36 124/45
2010/0154763 A1 * 6/2010 Su ..... F41A 17/48 124/40
2011/0283984 A1 * 11/2011 Hu ..... F41B 11/642 124/77
2014/0083400 A1 * 3/2014 Falkowski, II ..... F41B 11/89 124/16
2014/0290637 A1 * 10/2014 Maeda ..... F41A 17/38 124/74
2015/0176942 A1 * 6/2015 Hu ..... F41B 11/57 124/32
2016/0018175 A1 * 1/2016 Lallier ..... F41B 5/12 29/428
2016/0146567 A1 * 5/2016 Nachefski ..... F41B 11/62 124/73
2017/0160026 A1 * 6/2017 Walther ..... F41A 17/36
2018/0259282 A1 9/2018 Tolentino
2021/0381796 A1 * 12/2021 Buys ..... F41A 9/68

* cited by examiner

AIR GUN MAGAZINE SAFETY SYSTEM

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application is a continuation of and hereby claims priority to U.S. patent application Ser. No. 16/436,604 entitled "AIR GUN MAGAZINE SAFETY SYSTEM" filed Jun. 10, 2019, now issued as U.S. Pat. No. 10,883,784.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

This invention relates to air rifles using compressed air to propel a projectile through a barrel. In even greater particularity, the present invention relates to a safety system for an air gun that does not utilize a bolt probe.

Prior art large caliber pneumatic launching devices (i.e., air rifles) are limited to a valve size smaller than a projectile diameter. In order to maximize power delivered, high air pressures (e.g., greater than 3 k psi) must be used to compensate for the flow restriction of the valve being smaller than the projectile and barrel bore diameters. These prior art air rifles need relatively high pressure valves to deliver relatively high pressure air to the barrel bore and the projectile. Consequently, large opening forces are required to open the valve and fire the projectile. These pressure constraints and other considerations such as the use of probes to chamber projectiles require that the main valves and air orifices or tubes leading into the barrel in these guns are kept smaller than the projectile and bore diameter. Our unique valve system allows for much smaller opening forces relative to the caliber of the round being fired while keeping pressure high at the projectile while the projectile traverses the barrel bore.

All known prior art air rifles use probes to chamber rounds. This means that the main valve diameter or final orifice has a diameter less than the diameter of the projectile and diameter of the bore.

The bolt probe moves the release of compressed gases forward of the device (e.g., magazine) holding the projectile (s) for the air gun. Thus, prior art guns may be fired without a magazine present with no risk to the user or bystander such that to date, no magazine safety system has been needed.

BRIEF SUMMARY OF THE INVENTION

Aspects of the present invention provide an air gun with a magazine safety system and methods of making an air gun safe utilizing the magazine. More particularly, the air gun includes a magazine well protrusion (e.g., floorplate) configured to extend into the magazine well when no magazine is properly inserted into and received in the magazine well. In the extended position, the protrusion prevents actuation of the main valve of the air gun. When a magazine is properly inserted into the magazine well, the protrusion is pushed into a recessed or depressed position by the interaction of the magazine with the magazine well such that the protrusion does not prevent actuation of the main valve of the air gun.

In one aspect, and air gun includes a magazine well, a barrel, and a valve. The magazine well is configured to receive a magazine, said magazine having a projectile therein. The barrel is configured to receive the projectile from the magazine. The valve is configured to release pressurized gas into the magazine when said valve is actuated such that the projectile in the magazine is forced out of the magazine and through the barrel of the air gun by the pressurized gas released by the valve. The valve will not actuate when the magazine is not properly inserted into the magazine well.

In another aspect, a method of preventing a main valve of an air gun from actuating includes removing the magazine from the magazine well of the air gun. The valve releases pressurized gas into a barrel of the air gun when activated or actuated.

In another aspect, a method making safe and air gun includes preventing a main valve of the air gun from actuating to release pressurized gas into a barrel of the air gun when a magazine is not properly inserted into and received in a magazine well of the air gun.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
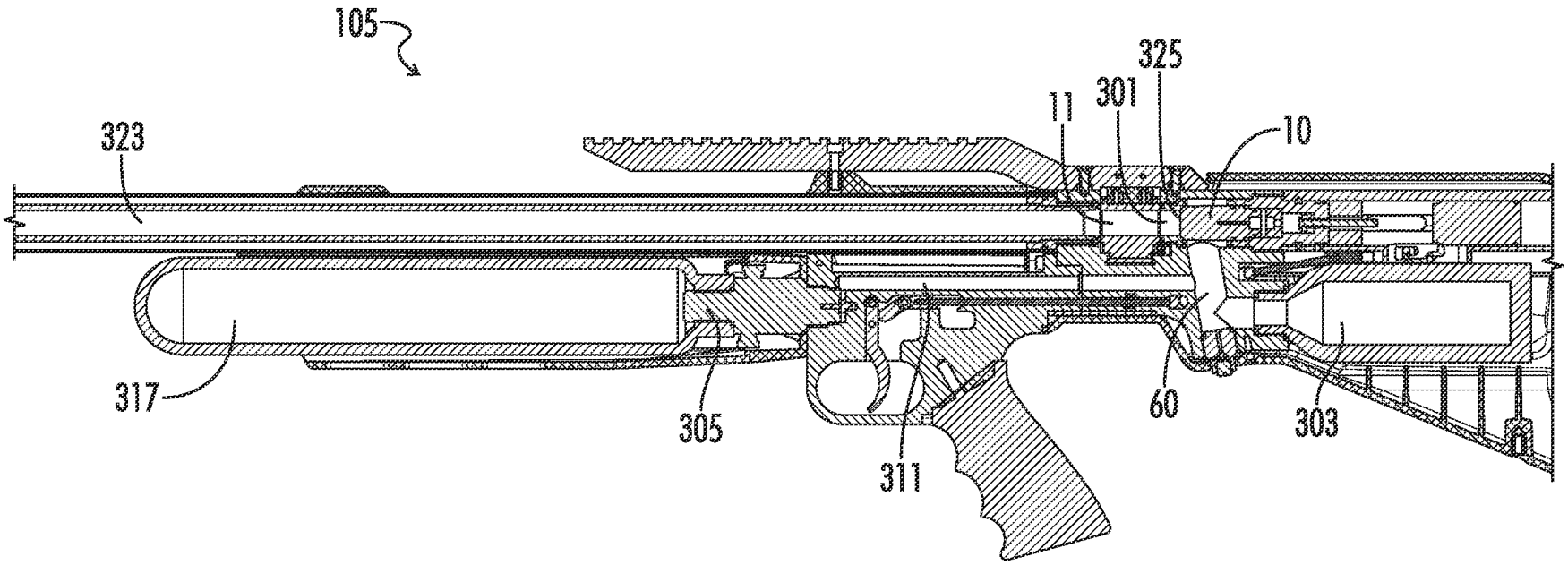
FIG. 1 shows a side partial cutaway view of an air gun with a magazine safety system.
Figure 2:
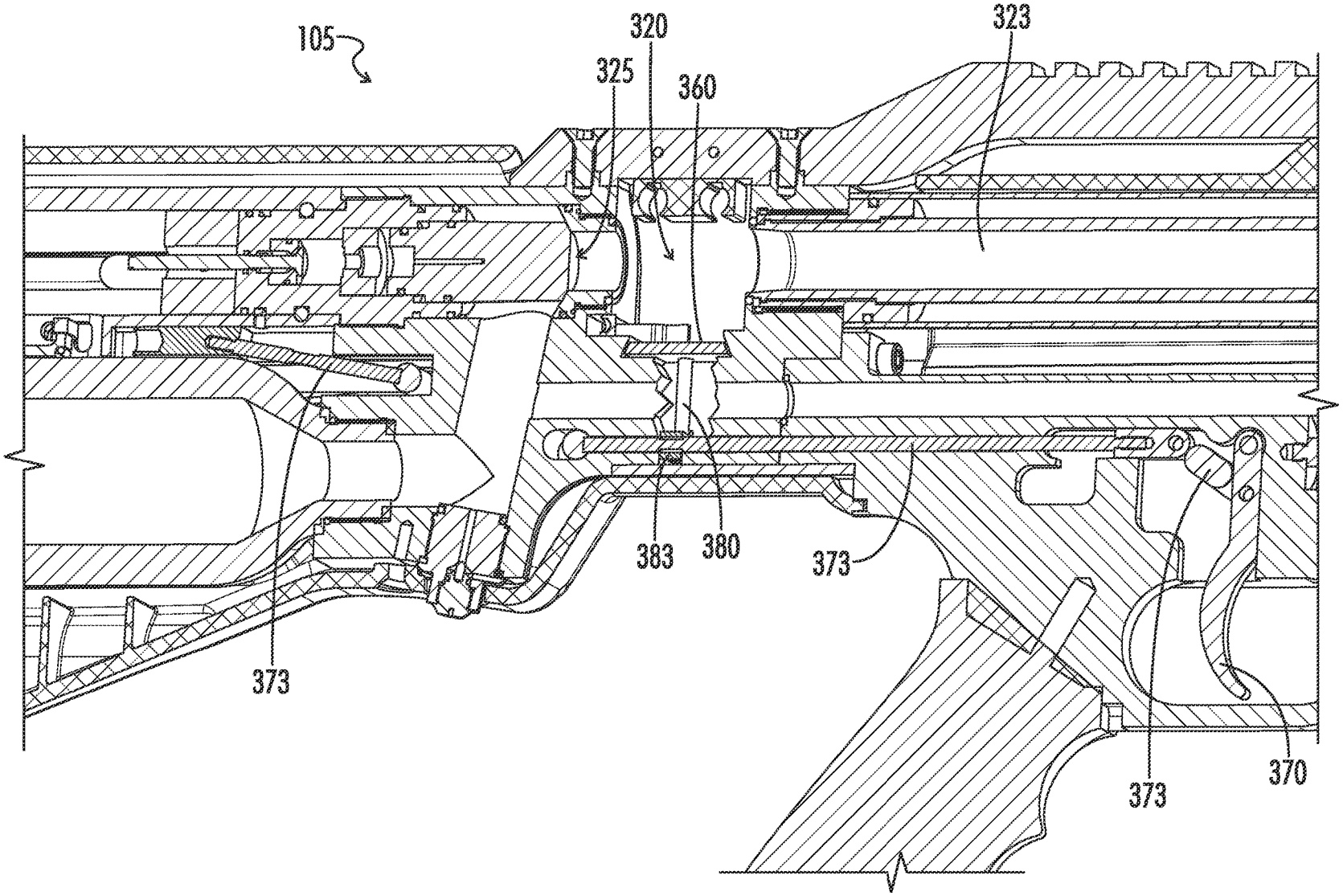
FIG. 2 shows a right side cut away view of the air gun of FIG. 1.
Figure 3:
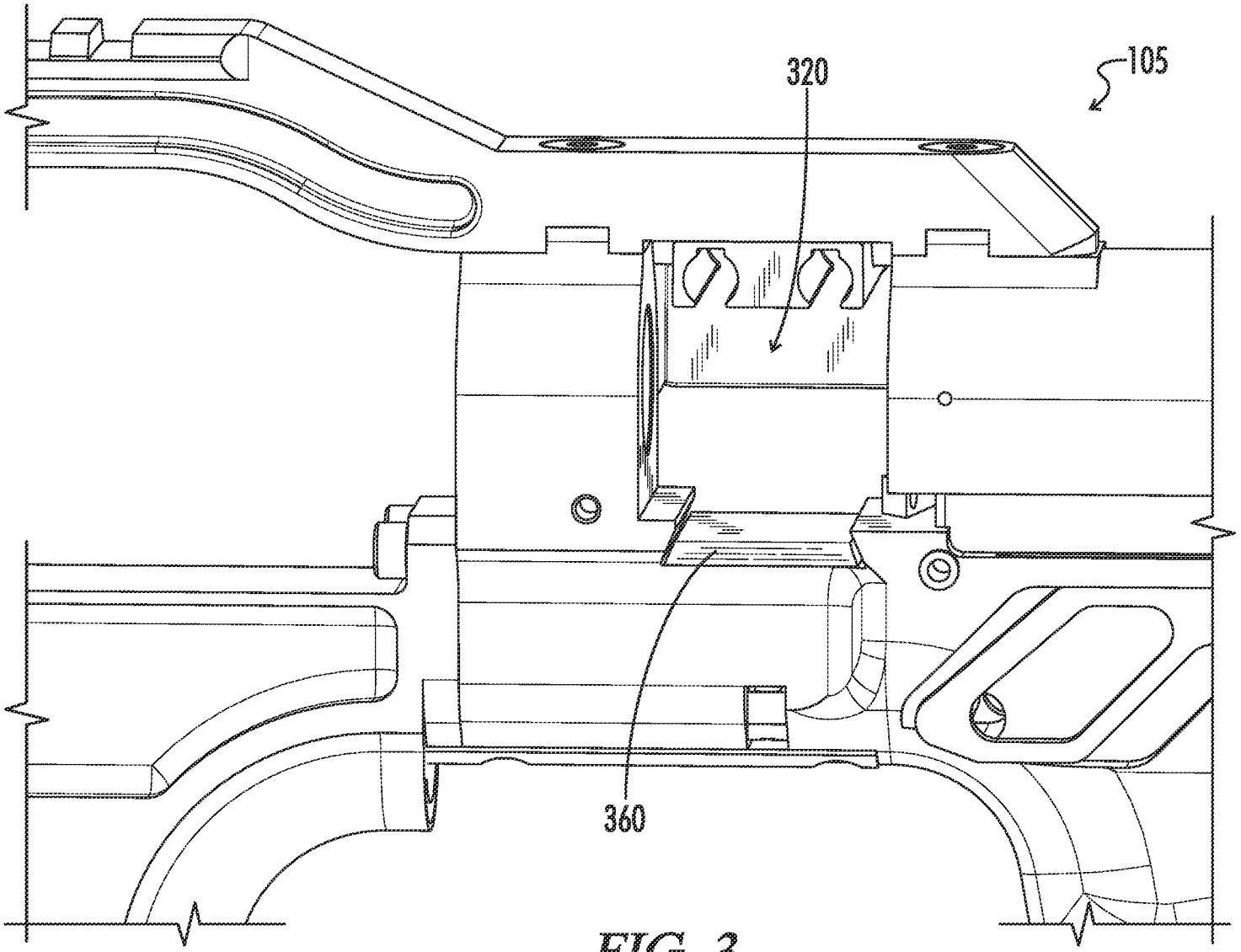
FIG. 3 shows a left side partially exploded view of the air gun of FIG. 1.
Figure 4:
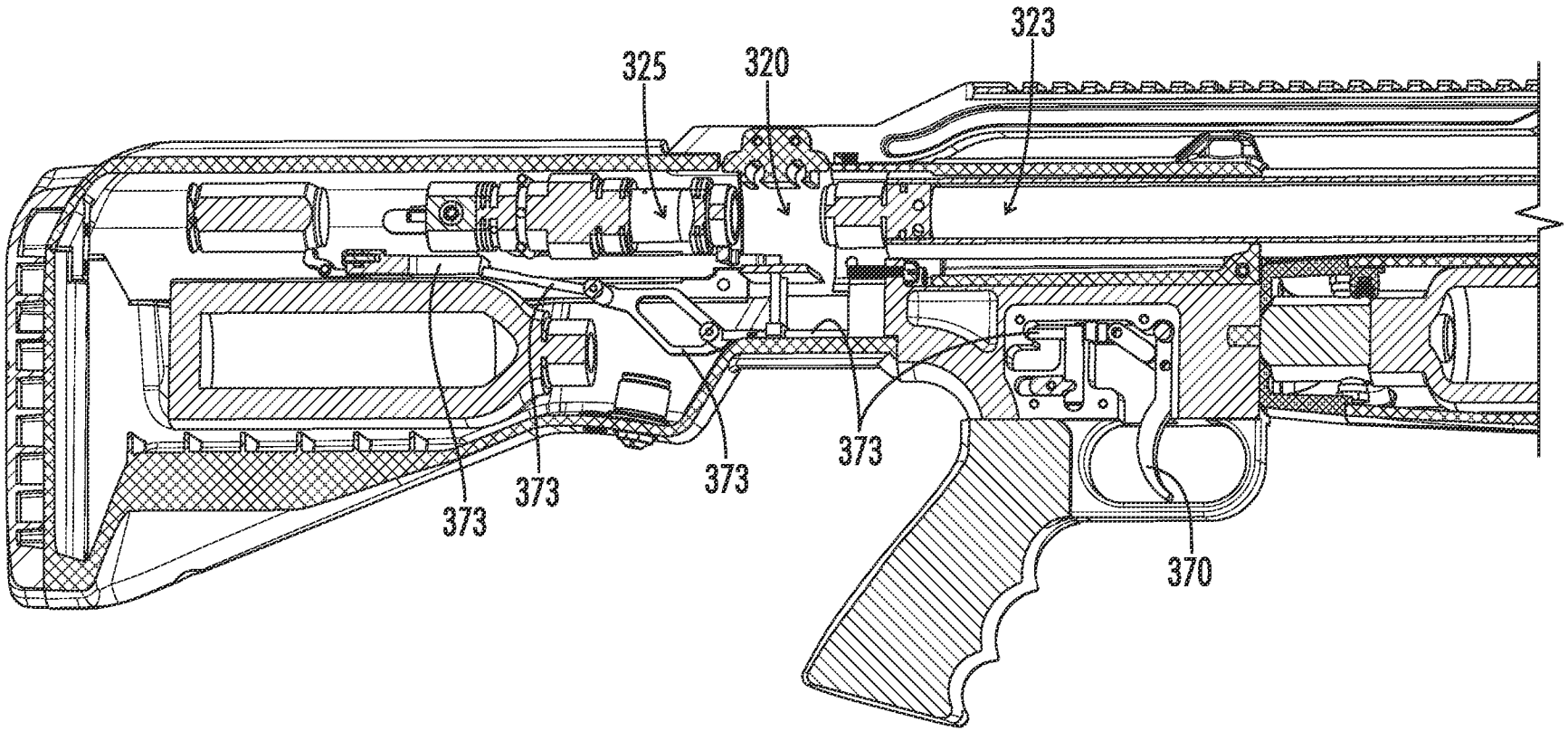
FIG. 4 shows a right side cut away view of the air gun of FIG. 1.
Figure 5:
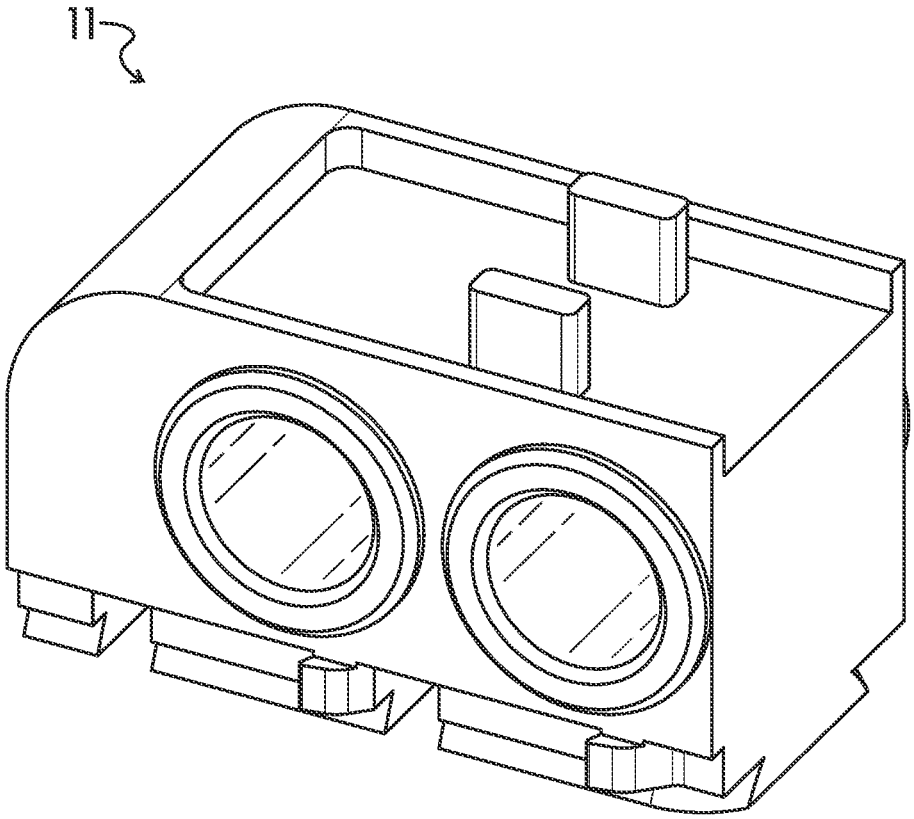
FIG. 5 shows a rear right isometric view of a linear magazine of the air gun of FIG. 1.
Figure 6:
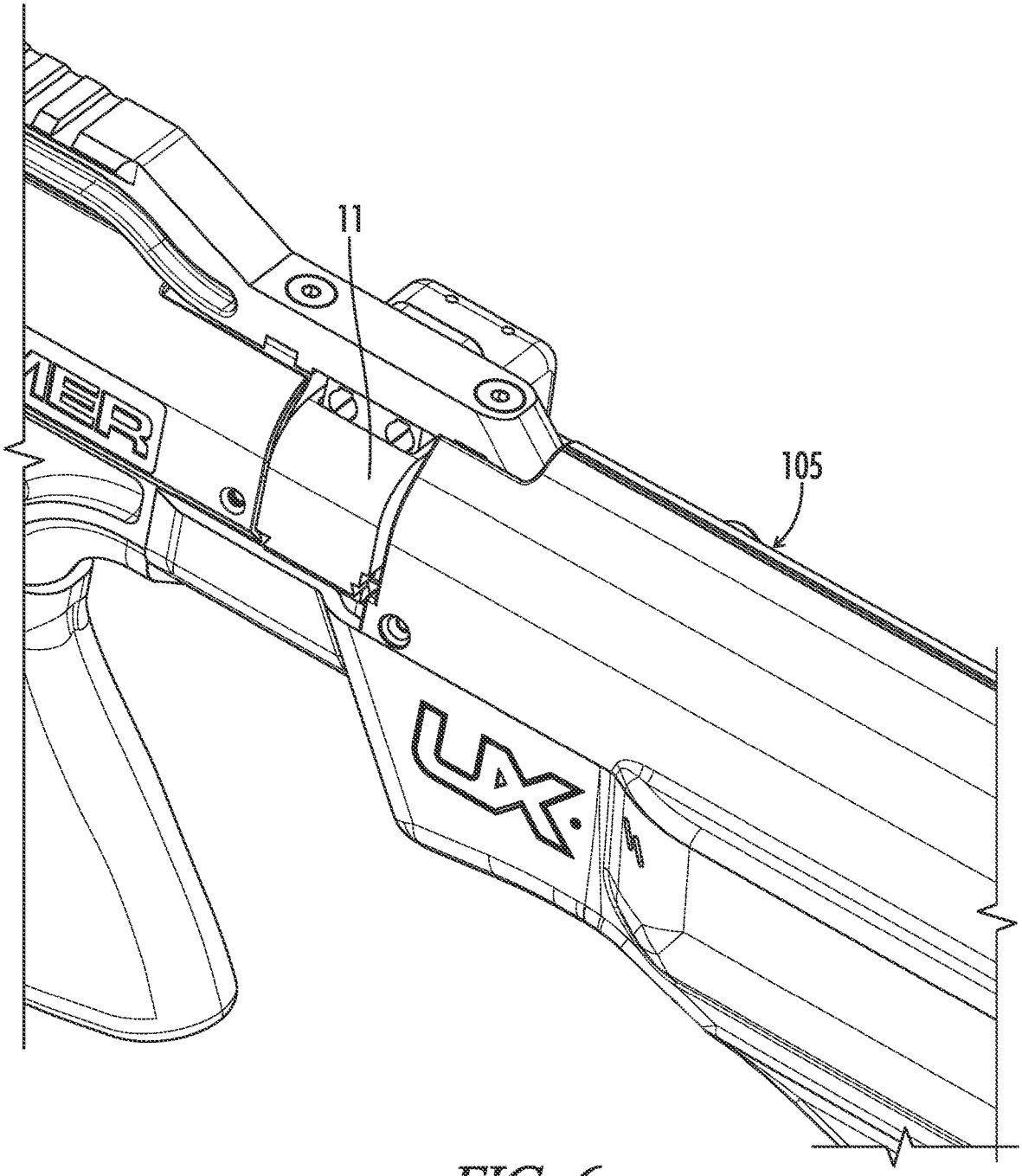
FIG. 6 shows a left rear isometric view of the air gun of FIG. 1 with the linear magazine of FIG. 5 properly inserted and received in a magazine well of the air gun.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The upright position of an air gun is a generally level firing position (i.e., held as if being intentionally discharged at a by a user at a target of the same general elevation as the user). The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states.

Energy transfer to the projectile from compressed gas is achieved when pressure on the rear face of the projectile remains constant or increases as the projectile traverses the barrel. In firearms, increasing pressure as the projectile traverses the barrel is readily achieved because the burning powder (i.e., smokeless or black powder) supplies an increasing gas volume and pressure until after the projectile exits the barrel (assuming the cartridge has been loaded with an appropriate amount of powder). However, in air rifles, increasing pressure beyond the pressure of the reservoir supplying air to the projectile and barrel is not possible. Thus, in air rifles, maintaining the pressure of the pressurized gas reservoir at the projectile (i.e., bullet) throughout the traversal of the projectile through the barrel is optimal. Aspects of the present invention include balancing a shot reservoir volume to barrel volume and shot reservoir diameter to barrel diameter in order to accomplish near static pressure at the projectile throughout its traversal of the barrel upon firing of the air rifle.

Linear Magazine Air Gun

Referring to FIG. 1, in one embodiment, an air gun 105 capable of firing from a linear magazine 11 without the use of a bolt probe is shown. That is, the air gun 105 is configured to supply pressurized air from a main valve assembly to a magazine having a projectile therein, and the magazine communicates the pressurized air and projectile into a barrel of the air gun 105. The air gun 105 has a valve bore having an internal diameter formed by a main valve seat insert 301. The main valve assembly of the air gun includes the valve seat (formed by valve seat insert 301) and the main valve body 10. In operation, a regulator 305 supplies the pressurized air from a bulk air supply 317 to the main valve assembly. In one embodiment, the bulk air supply 317 is a 24 cubic inch tank holding air at 4500 psi when fully charged, and the regulator 305 is set to 3000 psi. A tube 311 connects the regulator 305 to the shot bottle 303 and propulsion chamber about the main valve body 10. The air gun 105 includes the main valve body 10 configured to interface with the face of the valve seat (e.g., main valve insert 301) to selectively provide pressurized air to the barrel when the firing valve (i.e., vent valve formed by poppet 43 and vent valve seat 41) and main valve assembly (i.e., main valve body 10 and main valve seat 301) are triggered, fired, or actuated. In one embodiment, the main valve body 10 has an outer diameter of approximately 1" and the propulsion chamber 21 has a diameter of approximately 1.5" such that there is about ¼" of pressurized gas surrounding the main valve body 10 where it interfaces with the main valve seat 301.

A diameter of the final orifice of the valve seat 301 is the internal diameter of the valve seat insert 301. The barrel 323 has a bore diameter. In one embodiment, the internal diameter of the valve seat is at least as large as the bore diameter of the barrel. In one embodiment, the internal diameter 315 of the valve seat 16 is larger than the bore diameter of the barrel 323. In one embodiment, the internal diameter of the main valve seat is approximately 0.510" and the diameter of the bore is approximately 0.500". In one embodiment, the valve seat 301 has an external diameter that is at least 1.5 times the bore diameter of the barrel. In one embodiment, the external diameter 313 of the main valve seat 16 is approximately 0.971 inches in the bore barrel is approximately 0.500 inches such that the external diameter of the valve seat 301 is approximately twice the bore diameter of the barrel. In one embodiment, the main valve body 10 has an external diameter that is at least 1.5 times the bore diameter of the barrel 323.

Examples of linear magazine based air guns are described in, for example U.S. patent application Ser. No. 16/141,857 entitled "LINEAR CHAMBER MAGAZINE" filed on Sep. 25, 2018 and U.S. patent application Ser. No. 16/291,961 entitled "VALVE SYSTEM FOR AIR GUN" filed on Mar. 4, 2019, the entire disclosures of which are incorporated herein.

Magazine Safety System

All prior art high power or large bore air guns have either been single shot air gun or utilized a bolt probe. Single shot air guns do not employ a magazine at all, and it is therefore impossible to have a magazine safety system on such a gun. Bolt probe based air guns use the bolt probe to move a projectile from a magazine into a chamber and then supply the pressurized air to the projectile through the bolt probe (which is hollow). The bolt probe completes the rear of the chamber, so whether a magazine is present in the gun or not is irrelevant with respect to safety as long as the gun is prevented from firing if the bolt probe is not in a forward, locked position for firing. If the bolt probe is in the locked forward position, all air and any projectiles necessarily exit the gun from the muzzle. In contrast, air gun 105 supplies pressurized air directly to the magazine 11 which forms the chamber containing the projectile. Therefore, discharging the air gun 105 without the magazine 11 present in the magazine well of the air gun 105 will result in the release of very large amounts of 3000 psi gases right next to the face of a user holding the air gun 105 in a shooting position which could result in serious injury.

Referring to FIGS. 1-6, an air gun 105 includes a magazine well 320, a barrel 323, and main valve 325. Magazine well 320 is configured to a magazine 11, in the magazine 11 may have a projectile therein. The barrel 323 is configured to receive the projectile from the magazine 11. The valve 325 is configured to release pressurized gas into the magazine 11 when said valve 325 is actuated such that the projectile in the magazine 11 is forced out of magazine 11 and through the barrel 323 of the air gun 105 by the pressurized gas released by the valve 325. The valve 325 will not actuate when the magazine 11 is not properly inserted into the magazine well 320. In one embodiment, the air gun 105 further includes the magazine 11. In one embodiment, the magazine 11 is a linear magazine. In one embodiment, the magazine 11 is configured to hold a plurality of projectiles to be fired from the air gun 105 by pressurized gas released from the valve 325 when actuated. In one embodiment, the air gun 105 does not have a bolt probe.

In one embodiment, the air gun 105 further comprises a magazine well protrusion 360. The magazine well 320 is complementary to the magazine 11 such that the magazine 11 can be inserted into and received in the magazine well 320, except that the magazine well protrusion 360 extends into the space into which the magazine 11 is to be received by the magazine well 320 until the magazine 11 is properly inserted into and received in the magazine well 320. The air gun 105 is configured to bias the magazine well protrusion 360 into an extended position when the magazine 11 is not properly received in the magazine well 320. The magazine well 320 of the air gun 105 is configured to cause the magazine 11 to force the magazine well protrusion 360 from the extended position into a retracted position when the magazine 11 is properly inserted into and received in the magazine well 320. In one embodiment, the magazine well protrusion 360 is a floorplate forming a bottom of the magazine well 320, and the magazine 11 depresses the floorplate 360 from the extended position into the retracted position when the magazine 11 is properly inserted into and received in the magazine well 320.

In one embodiment, the air gun 105 further includes a trigger 370 (e.g., a trigger shoe) and a trigger linkage 373. The trigger 370 is configured to receive input from the user, wherein the input is pulling the trigger 370 rearward with respect to the air gun 105. In this context, rearward means pulling the trigger 370 toward the butt of the air gun 105 and/or away from the muzzle of the barrel 323 of the air gun 105. The trigger linkage 373 is configured to actuate the valve 325 in response to the input from the user. In one embodiment, the trigger linkage 373 is configured to actuate the valve 325 by moving longitudinally with respect to the air gun 105 in response to receiving the input from the user and actuating the valve 325 via said longitudinal movement. In this context, longitudinal means forward or rearward with respect to the butt and muzzle of the air gun 105 and/or generally parallel to a longitudinal axis of the barrel 323 of the air gun 105. The air gun 105 is configured to prevent longitudinal movement of the trigger linkage 373 when the magazine 11 is not properly received in the magazine well 320 such that the valve 325 of the air gun 105 is prevented from actuating when the magazine 11 is not properly inserted into and received in the magazine well 320. In one embodiment, the magazine well protrusion 360 (e.g., floorplate) is configured to restrict longitudinal movement of the trigger linkage 373 when in the extended position such that the trigger linkage 373 cannot actuate the valve 325 in response to the input from the user when the magazine 11 is not properly inserted into and received in the magazine well 320. In one embodiment, the magazine well protrusion 360 includes a hole through which the trigger linkage 373 passes at a point of reduced diameter of the trigger linkage 373. In the extended position, the larger diameter portion of the trigger linkage 373 interferes with a forward face of the magazine well protrusion 360 such that the trigger linkage 373 cannot be moved rearward. When the magazine well protrusion 360 is in the retracted or depressed position, the hole in the magazine well protrusion 360 aligns with the larger diameter portion of the trigger linkage 373 such that the larger diameter portion of the trigger linkage 373 can pass through the hole in the magazine well protrusion 360, enabling the trigger linkage 373 to move rearward in response to the input from the user (i.e., the user pulling the trigger 370). It is contemplated that the magazine well protrusion 360 may include multiple components such as a spring, the floorplate 360, linkage 380, and safety block 383 (i.e., the portion of the magazine well protrusion 360 having the hole through which the trigger linkage 373 and the face of which selectively prevents the trigger linkage 373 from moving rearward when the magazine well protrusion 360 is in the extended position).

In one embodiment, a method of making safe and air gun 105 includes preventing the main valve 325 of the air gun 105 from actuating to release pressurized gas when the magazine 11 is not properly inserted into and receive an the magazine well 320 of the air gun 105.

In one embodiment, a method of preventing the main valve 325 of the air gun 105 from actuating includes removing the magazine 11 from the magazine well 320 of the air gun 105.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful AIR GUN MAGAZINE SAFETY SYSTEM it is not intended that such references be construed as limitations upon the scope of this invention except as set forth in the following claims.

What is claimed is:

1. An air gun comprising:

a magazine well configured to receive a magazine, said magazine configured to contain a projectile therein;

a barrel configured to receive the projectile from the magazine; and a valve configured to release pressurized gas when said valve is actuated such that the projectile is forced through the barrel of the air gun by the pressurized gas released by the valve;

a trigger configured to receive input from a user;

a trigger linkage configured to actuate the valve in response to the input from the user; and a magazine well protrusion, wherein:

the magazine well is complementary to the magazine such that the magazine may be inserted into and received in the magazine well, except that the magazine well protrusion extends into the space into which the magazine is to be received by the magazine well unless the magazine is properly inserted into and received in the magazine well;

the air gun is configured to bias the magazine well protrusion into an extended position when the magazine is not properly received in the magazine well;

the magazine well of the air gun is configured to cause the magazine to force the magazine well protrusion from the extended position into a retracted position when the magazine is properly inserted into and received in the magazine well; and the magazine well protrusion is configured to restrict movement of the trigger linkage when in the extended position such that the trigger linkage cannot actuate the valve in response to the input from the user.

2. The air gun of claim 1, wherein the air gun further comprises the magazine.

3. The air gun of claim 1, wherein:

the air gun further comprises the magazine; and the magazine is a linear magazine.

4. The air gun of claim 1, wherein the air gun further comprises the magazine and the magazine is configured to hold a plurality of projectiles to be fired from the air gun by pressurized gas released from the valve when actuated.

5. The air gun of claim 1, wherein the air gun does not have a bolt probe.

6. The air gun of claim 1, wherein:

the magazine well protrusion is a floor plate forming a bottom of the magazine well;

the air gun is configured to bias the floorplate to an extended position when the magazine is not properly received in the magazine well; and the magazine well is configured to force the magazine to depress the floorplate from the extended position into a retracted position when the magazine is properly inserted into and received in the magazine well.

7. The air gun of claim 1, wherein the input from the user comprises pulling the trigger rearward with respect to the air gun.

8. The air gun of claim 1, wherein:

the trigger linkage is configured to actuate the valve in response to the input from the user by moving longitudinally with respect to the air gun in response to receiving the input from the user and actuating the valve via said longitudinal movement; and the air gun is configured to prevent longitudinal movement of the trigger linkage when the magazine is not properly received in the magazine well such that the valve of the air gun is prevented from actuating when the magazine is not properly inserted into and received in the magazine well.

9. The air gun of claim 1, further comprising:

a bulk air supply containing the pressurized gas.

* * * * *